US011515661B2

(12) United States Patent
Zechmann

(10) Patent No.: US 11,515,661 B2
(45) Date of Patent: Nov. 29, 2022

(54) PLUG ASSEMBLY FOR DATA CABLES

(71) Applicant: Neutrik AG, Schaan (LI)

(72) Inventor: Kevin Zechmann, Nenzing (AT)

(73) Assignee: Neutrik AG, Schaan (LI)

( * ) Notice: Subject to any disclaimer, the term of this patent is extended or adjusted under 35 U.S.C. 154(b) by 171 days.

(21) Appl. No.: 17/045,730

(22) PCT Filed: Apr. 4, 2019

(86) PCT No.: PCT/EP2019/000110
§ 371 (c)(1),
(2) Date: Mar. 29, 2021

(87) PCT Pub. No.: WO2019/192753
PCT Pub. Date: Oct. 10, 2019

(65) Prior Publication Data

US 2021/0098932 A1 Apr. 1, 2021

(30) Foreign Application Priority Data

Apr. 6, 2018 (AT) ..... A50283/2018
Dec. 19, 2018 (AT) ..... A51132/2018

(51) Int. Cl.
*H01R 13/625* (2006.01)
*H01R 13/516* (2006.01)
(Continued)

(52) U.S. Cl.
CPC ..... *H01R 13/516* (2013.01); *H01R 13/512* (2013.01); *H01R 13/533* (2013.01);
(Continued)

(58) Field of Classification Search
CPC .. H01R 13/512; H01R 13/516; H01R 13/533; H01R 13/5825; H01R 13/639; H01R 24/64
(Continued)

(56) References Cited

U.S. PATENT DOCUMENTS 4,703,989 A * 11/1987 Price ..... H01R 24/62 439/283
4,784,610 A * 11/1988 Stuart ..... H01R 13/633 174/67
(Continued)

FOREIGN PATENT DOCUMENTS

CN 1433111 A 7/2003
CN 201805068 U 4/2011
(Continued)

*Primary Examiner* — Abdullah A Riyami
*Assistant Examiner* — Vladimir Imas
(74) *Attorney, Agent, or Firm* — Volpe Koenig

(57) ABSTRACT

A plug arrangement for use with cables (K) having cable plugs (S) comprises a housing (1) for receiving the cable plug (S), a clamping element (5) encompassing the cable (K) and accommodated in the housing (1), which clamping element (5) clamps, in a compressed state, the cable (K), and a clamping sleeve (3) for establishing a threaded connection with the housing (1). When the threaded connection is tightened, the clamping element (5) is braced in the housing (1) and the cable (K) is clamped in the clamping element (5). The front end of the clamping element (5) facing the cable plug (S) is configured for receiving and positioning the cable plug (S) in a predetermined position at the front end of the clamping element (5) or is provided with at least one stop for the cable plug (S). Thus, when the threaded connection is tightened, the cable plug (S) is also positioned with respect to the housing (1) and the clamping element (5) so as not to rotate and fixed.

22 Claims, 12 Drawing Sheets

(51) Int. Cl.
*H01R 13/512* (2006.01)
*H01R 13/533* (2006.01)
*H01R 13/58* (2006.01)
*H01R 13/639* (2006.01)
*H01R 24/64* (2011.01)

(52) U.S. Cl.
CPC ..... *H01R 13/5825* (2013.01); *H01R 13/639* (2013.01); *H01R 24/64* (2013.01)

(58) Field of Classification Search
USPC ..... 439/345
See application file for complete search history.

(56) References Cited

U.S. PATENT DOCUMENTS 5,564,951 A * 10/1996 Attal ..... H01R 13/6658 439/930
5,567,174 A * 10/1996 Ericson, Jr ..... H01R 13/5216 439/462
5,957,706 A * 9/1999 Phillips, Jr ..... H01T 13/04 439/127
6,086,400 A * 7/2000 Fowler ..... H01R 13/622 439/321
6,582,248 B2 * 6/2003 Bachman ..... H01R 13/533 439/461
6,817,902 B2 * 11/2004 Bernardi ..... G02B 6/3893 439/462
6,935,886 B2 * 8/2005 Hoch ..... H01R 13/506 439/462
7,303,418 B2 * 12/2007 O'Connor ..... H01R 13/5208 439/369
7,892,018 B1 * 2/2011 Tobey ..... H01R 24/64 439/441
7,938,674 B2 * 5/2011 Lindkamp ..... H01R 13/59 439/461
7,988,476 B2 * 8/2011 Billman ..... H01R 13/5202 439/271
8,651,889 B2 * 2/2014 Krech ..... H01R 13/533 439/367
8,672,705 B2 * 3/2014 Schneider ..... H01R 13/631 439/470
8,814,608 B2 * 8/2014 Song ..... H01R 13/52 439/348
8,876,405 B2 11/2014 Larson et al.
9,160,099 B2 * 10/2015 Pfiffi ..... H01R 13/5205
9,172,188 B2 * 10/2015 Sticker ..... H01R 43/16
9,270,048 B2 * 2/2016 Harwath ..... H01R 13/5213
9,306,315 B2 * 4/2016 Scholten ..... H01R 13/52
9,312,629 B2 * 4/2016 Smith ..... H01R 13/625
9,531,122 B2 * 12/2016 Iida ..... H01R 13/6272
9,948,027 B2 * 4/2018 Sandwith ..... H01R 13/58
9,958,617 B2 * 5/2018 Koch ..... H01R 13/502
10,090,623 B2 * 10/2018 Campschroer ..... H01R 13/514
10,186,804 B2 * 1/2019 Menolotto ..... H01R 13/6277
2003/0100215 A1 5/2003 Bachman
2011/0243567 A1 10/2011 Su et al.
2012/0009807 A1 * 1/2012 Kuo ..... H01R 24/30 439/131
2015/0171577 A1 6/2015 Han et al.
2018/0269618 A1 9/2018 Lin

FOREIGN PATENT DOCUMENTS

CN 102082354 A 6/2011
CN 102222844 A 10/2011
CN 202405491 U 8/2012
CN 202495629 U 10/2012
CN 103326179 A 9/2013
CN 204030082 U 12/2014
CN 104600486 A 5/2015
CN 104716492 A 6/2015
CN 204407595 U 6/2015
CN 206401612 U 8/2017
CN 206471585 U 9/2017
CN 107667453 A 2/2018
EP 1317025 B1 3/2008
EP 2365586 B1 11/2015
EP 2302743 B1 7/2019
RU 2577388 C2 3/2016
TW M546037 U 7/2017
WO 2016195209 A1 12/2016

* cited by examiner

PLUG ASSEMBLY FOR DATA CABLES

RELATED APPLICATIONS

This application is a national stage under 35 U.S.C. § 371 of International Application No. PCT/EP2019/000110, filed Apr. 4, 2019, which claims priority of Austrian Patent Application No. A50283/2018, filed Apr. 6, 2018 and Austrian Patent Application No. A51132/2018, filed Dec. 19, 2018.

OVERVIEW

The present disclosure relates to a plug arrangement for use with cables having cable plugs, as well as a plug connection using such a plug arrangement.

The transmission of electronic data between computing systems via cable is generally known. These cables usually have a plug and/or plug connector, whose configuration is similar to a rectangular telephone plug, having multiple pins. A widely used 8-pin plug is known as "RJ-45" plug among experts. In some applications, the standardized RJ-45 plug is prone to damage and outages. For example, it is not well-suited for repeated plugging and unplugging into and out of particularly a chassis plug socket, the contacts are easily bent or shifted when inserted incorrectly. The plastic latch (spring arm) can fatigue and break so that the plug then no longer fits tightly in the socket. The cable itself is prone to faults due to repeated kinking at the location at which the cable enters the plug socket. Furthermore, the cable can also be pulled out of the plug due to longitudinal strain. The plug housing is formed of plastic and is easily deformed or broken, for example, if being accidentally stepped on. The mentioned disadvantages also apply to other cable connections such as fiber-optic cables, electric cables and many more.

Thus, an arrangement according to EP 1 317 025 B1 has been proposed as a protection for the delicate cable plugs. Moreover, NEUTRIK AG distributes a cable plug protector for pre-assembled cable plugs under the designation NE8MC, consists of housing, stop washer, clamping element, clamping sleeve and anti-kink means. A housing for receiving the actual cable plug has an external thread for establishing, together with a clamping bushing and/or cap nut or clamping nut having an internal thread, for forming a threaded connection. A radially compressible clamping element encompassing the cable is accommodated inside the housing and partially also inside the clamping sleeve, which clamping element, in a compressed state, clamps the cable in the housing. When the threaded connection is tightened, the clamping sleeve, the clamping element, the housing, the cable plug and the cable are braced together, and clamping sleeve, clamping element, cable plug and housing form a plug arrangement which can be connected to a complementary element such as a plug socket by being plugged together. Depending on the specific embodiment of the cable plug, furthermore, additional adapter pieces fitted to the respective plug must be inserted between the front end of the collet and the cable plug, which increases the installation time and installation effort in a disadvantageous manner. Moreover, suitable adapter pieces must be on hand for each kind of cable plug.

A collet having forwardly protruding fingers for positioning a data plug is also disclosed in CN 204030082 U. In this regard, one of these fingers also serves for holding down the locking tongue of the data plug. The fingers of the embodiment, however, are not configured for accommodating and correctly positioning data plugs of different dimensions, even in the longitudinal direction. Moreover, the collet cannot be used for pre-assembled cables as it has to be pushed onto the cable from the front, only after which the plug can be mounted on the cable. A recess in the housing for accommodating the locking tongue is not provided, either.

The fingers of the collet disclosed in CN 201805068 U also do not allow the safe and correct positioning of data plugs of different dimensions.

By contrast, CN 204030082 U discloses that the front end of a clamping element facing the cable plug is formed for receiving and positioning the cable plug in a predetermined position—both about the longitudinal axis of the plug arrangement and in the longitudinal direction thereof—on the front end of the clamping element or is provided with at least one stop for the cable plug. When the threaded connection is tightened, the cable plug is positioned so as not to rotate with respect to the housing and the clamping element and fixed, preferably also in the direction of the longitudinal axis at a defined position. At least one constriction of the cross-section is arranged in the direction of the longitudinal axis inside the housing as a stop for the front end of the clamping element, so that the clamping element supports itself, at least when the threaded connection is tightened, in the direction of the longitudinal axis against the cross-section constriction and is exactly positioned in the direction of the longitudinal axis of the housing. At least when the threaded connection is tightened, the clamping element is clamped between the cross-section constriction and the clamping sleeve or an element cooperating therewith and exactly positioned in the direction of the longitudinal axis of the housing.

In a similar manner, CN 103326179 shows a clamping element whose front side forms a stop for the cable plug and also holds the same in a predetermined position about the longitudinal axis of the plug arrangement. Here, however, the protective housing consists of two partial elements plugged together. When the threaded connection is tightened, the cable plug is positioned so as not to rotate and fixed, preferably also in the direction of the longitudinal axis at a defined position. A cross-section constriction is formed on the housing as a stop for an offset on the cable plug, at which the clamping element supports itself, at least when the threaded connection is tightened, and thus exactly positions itself also in the direction of the longitudinal axis. The clamping element is, at least when the threaded connection is tightened, clamped between the cross-section constriction and the clamping sleeve or an element cooperating therewith. It has, on its outside, reinforcement webs extending in the longitudinal direction.

The inventors have recognized a need for a simply constructed and quick to install device for protecting a cable plug regardless of its kind and for any kind of cables while avoiding the disadvantages of the prior art, by means of which device the risk of damage during plugging into a corresponding plug socket, while it is inserted in the plug socket and during the unplugging out of the plug socket can be avoided or reduced.

In this regard, the clamping element is preferably guided within the housing so as not to rotate about the housing's longitudinal axis, whereby an even quicker and simpler installation can be achieved and combined with an optimal fixation and positioning of the cable plug in the assembled state of the plug arrangement.

In order to ensure, with means as simple and fail-safe as possible, that the clamping element does not rotate in the housing while still achieving an easy longitudinal displaceability, at least one guide for the clamping element, which guide extends in parallel to the direction of the longitudinal axis, is arranged inside the housing according to a further optional feature. Said guide advantageously cooperates with a complementary structure on the clamping element, if necessary even with the cable plug itself, in particular with its side edges, and thus leads to the desired longitudinal guide without rotation of the clamping element.

In an advantageous manner, multiple fingers distributed circumferentially about the central longitudinal axis and oriented in parallel thereto are formed at the front end of the clamping element as a receptacle and/or stop for the cable plug and as a stop for a broken-through dividing wall of the housing provided with a recess, which fingers, when the threaded connection is tightened, abut on said dividing wall. Thus, a simple, quick, precise and yet safe positioning as well as fixation of the cable plug is ensured, which can still be easily inserted into the front end of the clamping element.

In this regard, it is preferably provided that the guide for the clamping element and the complementary structure on the clamping element are formed as a web extending in parallel to the direction of the longitudinal axis of the housing and as a slot extending in parallel to the direction of the longitudinal axis of the housing.

In this regard, preferably at least one shoulder is formed laterally in the circumferential direction—with respect to the direction of the longitudinal axis of the plug arrangement—on at least one of the fingers as a receptacle and/or stop for the cable plug. At least when the threaded connection is tightened, the rear end of the cable plug abuts on at least one of the shoulders or, as an alternative to this, is accommodated between the fingers and thus securely positioned. By means of the location and depth of the shoulder, preferably multiple shoulders arranged in a tiered manner, a different dimensioning of the receiving region for the cable plug can be offered, if necessary in combination with a different rotational position of the clamping element about the cable longitudinal axis. Thus, a clamping element designed in such manner and a plug arrangement containing said clamping element is suited for receiving cable plugs of different dimensions, wherein for all kinds of cable plugs, the exact and safe positioning within the housing of the plug arrangement is guaranteed.

According to an advantageous further embodiment of the plug arrangement, a web protruding radially inward is formed on at least one of the fingers. By means of these webs, an increased stability of the clamping element and in particular of the fingers can be achieved.

Moreover, at least one of the fingers is preferably positioned and dimensioned such that a possible spring arm of the cable plug is retained in a position pressed toward the housing of the cable plug by means of said finger. Thus, the spring arm does not obstruct the coupling and latching of the plug connection accomplished solely by the plug arrangement, and also does not have to be removed manually in an additional, complex working step, risking damage to the cable plug.

An embodiment of the clamping element that is easy to produce and robust is characterized in that the clamping element has a cylindrical middle part adjoining the fingers of the front end and a preferably conically tapering rear end opposing the fingers.

In order to ensure the best possible strain relief, the conically tapering rear end of the clamping element preferably has at least two radially compressible fingers whose surfaces facing the cable are configured for an increased positive or frictional connection with the cable.

According to a further optional feature, a very robust embodiment of the plug arrangement has a housing formed of die-cast metal or plastic. Naturally, the use of other materials is also conceivable.

A further embodiment of the plug arrangement is characterized in that, furthermore, a recess is provided in the housing for receiving a possible spring arm of the cable plug and/or a finger of the clamping element, wherein, if applicable, the spring arm is retained in the recess in a pressed position.

A plug arrangement having a clamping element, which has a continuous longitudinal slit parallel to the axis along the length of the clamping element, wherein the clamping element can be elastically pulled apart in the circumferential direction and pushed onto the cable, ensures a quick and safe installation of the plug arrangement on the cable plug having a cable plug using a small number of components.

For achieving the initially stated object, there is also a plug connection provided, using a plug connection according to one of the preceding claims.

The plug connection may be characterized in that, for forming at least one electric connection, furthermore, a plug socket for correspondingly receiving the plug arrangement is provided. Thus, an optimal protection of the delicate cable plug can be ensured even in a rough environment.

A preferred embodiment provides that the housing and the plug socket are provided with complementary structures for longitudinally guiding the housing in the plug socket, in order to ensure the orientation of the plug arrangement with respect to the plug socket upon insertion of the plug arrangement into the socket.

In this regard, the housing is preferably provided with a longitudinal slot and the plug socket is provided with a corresponding counter-longitudinal rib for ensuring the orientation of the plug arrangement with respect to the plug socket upon insertion of the plug arrangement into the socket.

A further optional embodiment of such a plug connection additionally provides a snap latch for the releasable connection of the plug arrangement to the plug socket, in order to safely avoid the inadvertent removal of the cable plug. In the process, the snap latch meshes with an indentation on the outside of the housing.

Finally, a further subject-matter is a clamping element for use in a plug arrangement for use with cables having cable plugs, wherein said plug arrangement and the clamping element are formed according to one of the paragraphs above. These plug arrangements and clamping elements may be used particularly with data cables such as RJ45 cables, but also with optical fibers, electric cables and the like.

BRIEF DESCRIPTION OF THE DRAWINGS

For the purpose of better understanding of the invention, it will be elucidated in more detail by means of the figures below.

These show in a respectively very simplified schematic representation.

DETAILED DESCRIPTION OF PREFERRED EMBODIMENTS

First of all, it is to be noted that in the different embodiments described, equal parts are provided with equal reference numbers and/or equal component designations, where the disclosures contained in the entire description may be analogously transferred to equal parts with equal reference numbers and/or equal component designations. Moreover, the specifications of location, such as at the top, at the bottom, at the side, chosen in the description refer to the directly described and depicted figure and in case of a change of position, these specifications of location are to be analogously transferred to the new position.

Figure 1:
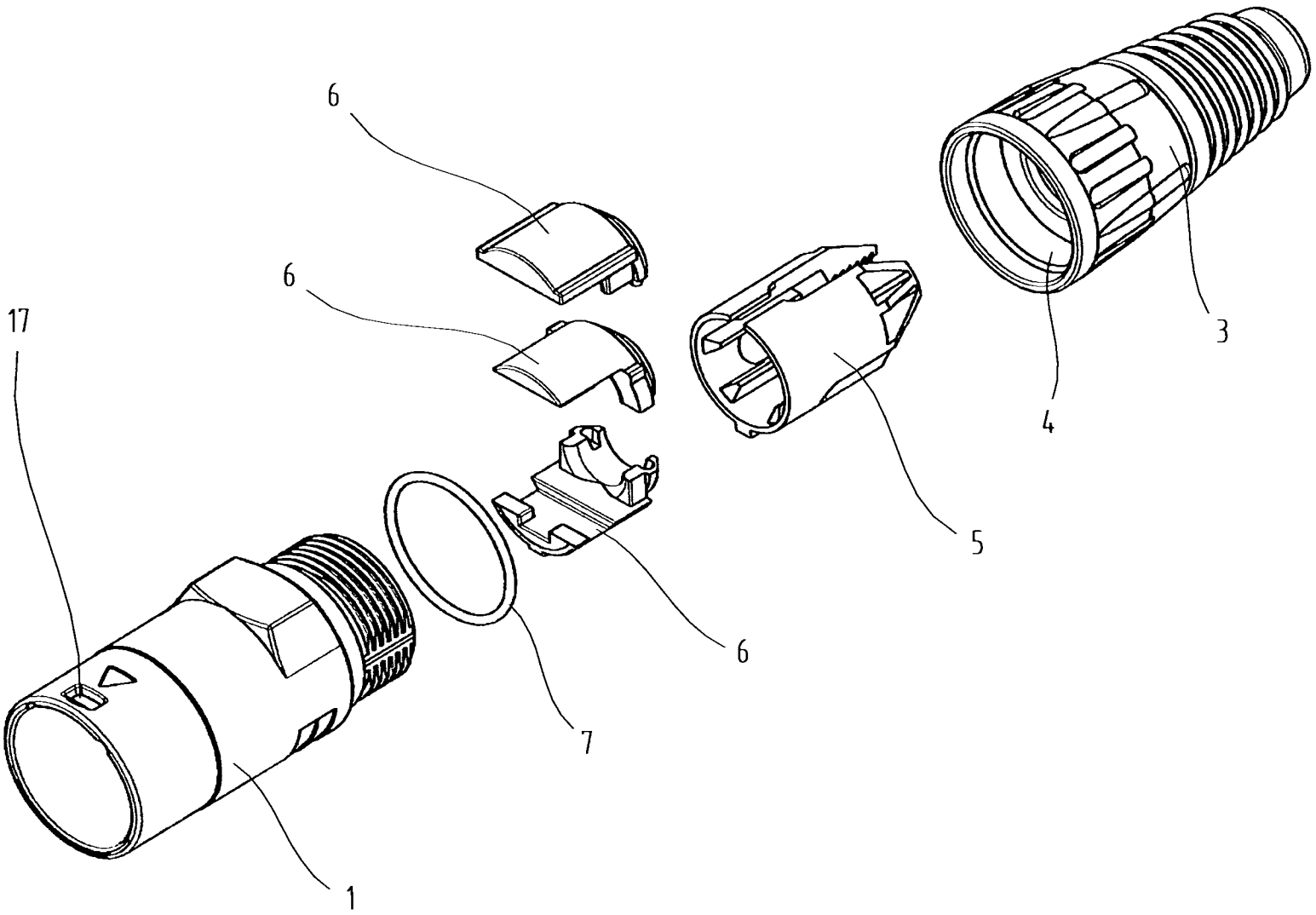
FIG. 1 a plug arrangement according to the prior art in an exploded view.

The plug arrangement shown in FIG. 1 as cable plug protection particularly for pre-assembled RJ45 plugs consists of a housing 1 configured for plugging into a plug socket, wherein the rear end of said housing 1 is provided with an external thread 2. In the installed state of the plug arrangement, the cable plug is accommodated and fixed inside said housing 1. A clamping sleeve 3 can be screwed onto the housing 1 from behind, meaning from the cable side, thus forming a threaded connection. Additionally, an internal thread 4 is arranged on the front end of the clamping sleeve 3 facing the housing 1. At the latest when this threaded connection is formed, this also compresses a radially compressible clamping element 5 encompassing the data cable and with that clamps the cable in the clamping element 5 and thus also in the plug arrangement. Thus, when the threaded connection is tightened, the clamping sleeve 3, the clamping element 5, the housing 1, and the cable are braced together.

For positioning and fixating the cable plug S in the housing 1, at least two adapter pieces 6 are provided according to the prior art shown in FIG. 1, which adapter pieces 6 must be mounted around the cable plug and inserted, with a rear offset, into the front end of the clamping element 5. The entire arrangement must then, in this configuration in which it is manually held by the user, also be manually inserted into the housing 1. The plug arrangement is supplemented with a washer 7, which is inserted between the housing 1 and clamping sleeve 3 and ensures the dust- and water tightness. This plug arrangement as explained above upgrades a conventional cable plug such as a RJ45 plug to an extremely robust and lockable solution. For different kinds of cable plugs, the adapter pieces 6 are to be selected accordingly.

A further improved solution with fewer components and a simpler assembly is shown in FIGS. 2 to 17. The plug arrangement according to the invention is applicable for all kinds of cable plugs and cables, in particular for data cables and RJ45 cable plugs, but also for optical fibers and their correspondingly configured plug connections, for electric cables and many more. Instead of cable plugs with multiple contact elements, individual contacts can also be used. In the following, the invention is explained with the aid of exemplary embodiments for data cables with RJ45 cable plugs, which, however, is not to be understood in a limiting sense.

Figure 2:
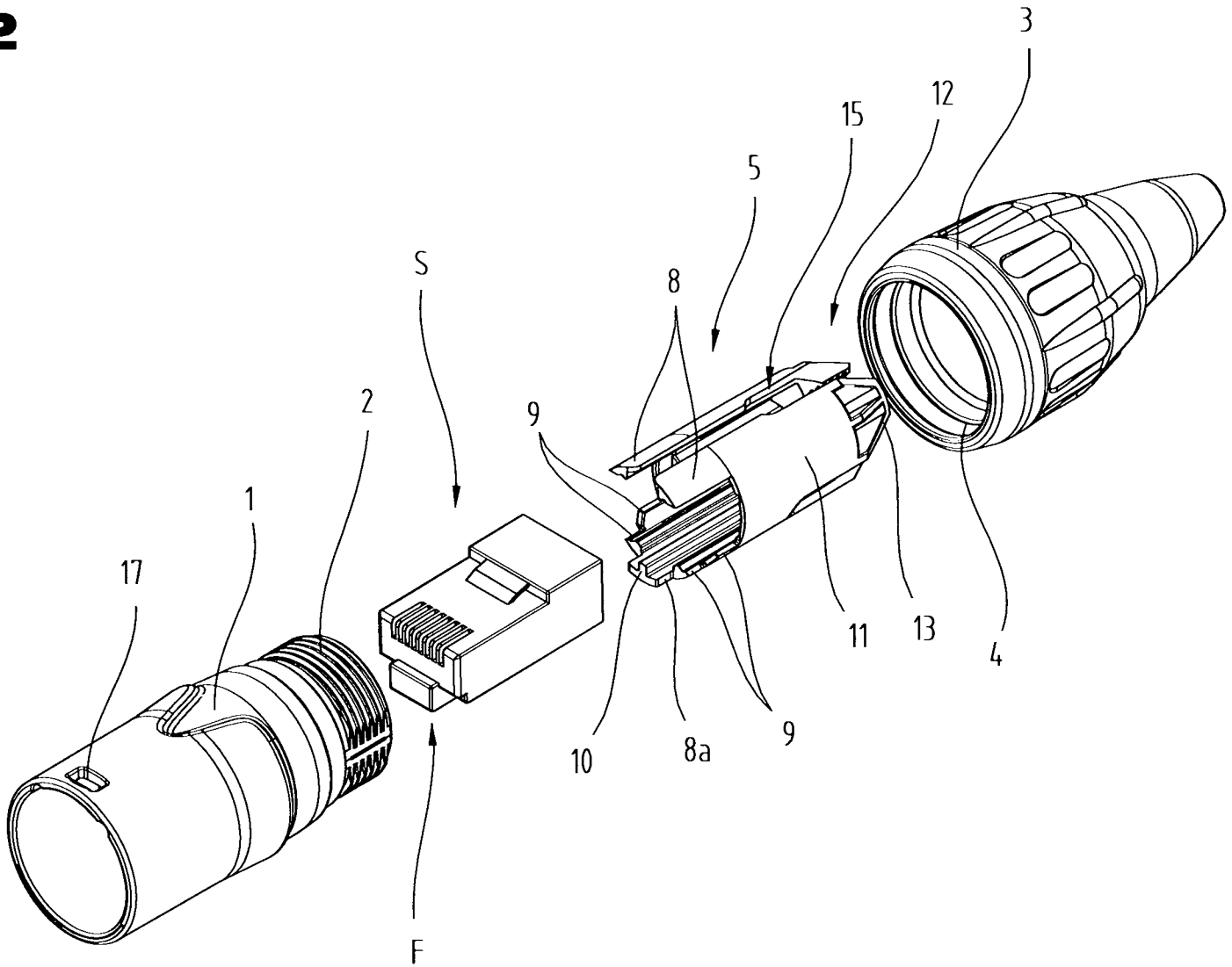
FIG. 2 an exemplary embodiment of a plug arrangement, also in an exploded view, with a depiction of the cable plug.

As can be seen in FIG. 2, only one clamping element 5 is inserted inside the preferably cylindrical housing 1 open on both sides and the clamping sleeve 3 preferably conically tapered toward the back, which clamping element 5, however, is already configured itself at the front end facing the housing 1 for receiving and positioning a cable plug S having a spring arm F—for purposes of clarity of the representation, the cable is not depicted here—in a predetermined position within the housing 1. The housing 1 is preferably made of die-cast metal, in particular zinc die-casting preferably having one coating, in particular of nickel or chromium. Housings 1 made of plastic are also possible, of course. In this regard, the clamping element 5, preferably made of polyacetal (POM) or also polyamide (PA), is freely rotatable about the central cable axis as long as it is located outside the housing 1 and the threaded connection between the housing 1 and the clamping sleeve 3—in FIG. 4, a section view of a plug arrangement consisting of housing 1, clamping sleeve 3 and clamping element 5 is shown in the longitudinal view—is not yet established. Thus, it can be mounted on the cable during the assembly of the plug arrangement in any position. Only after insertion into the housing 1, the clamping element 5 is then held so as not to rotate by means of guide structures that will be explained below, and therefore the cable plug is also positioned, braced and fixed with respect to the housing 1.

Figure 3:
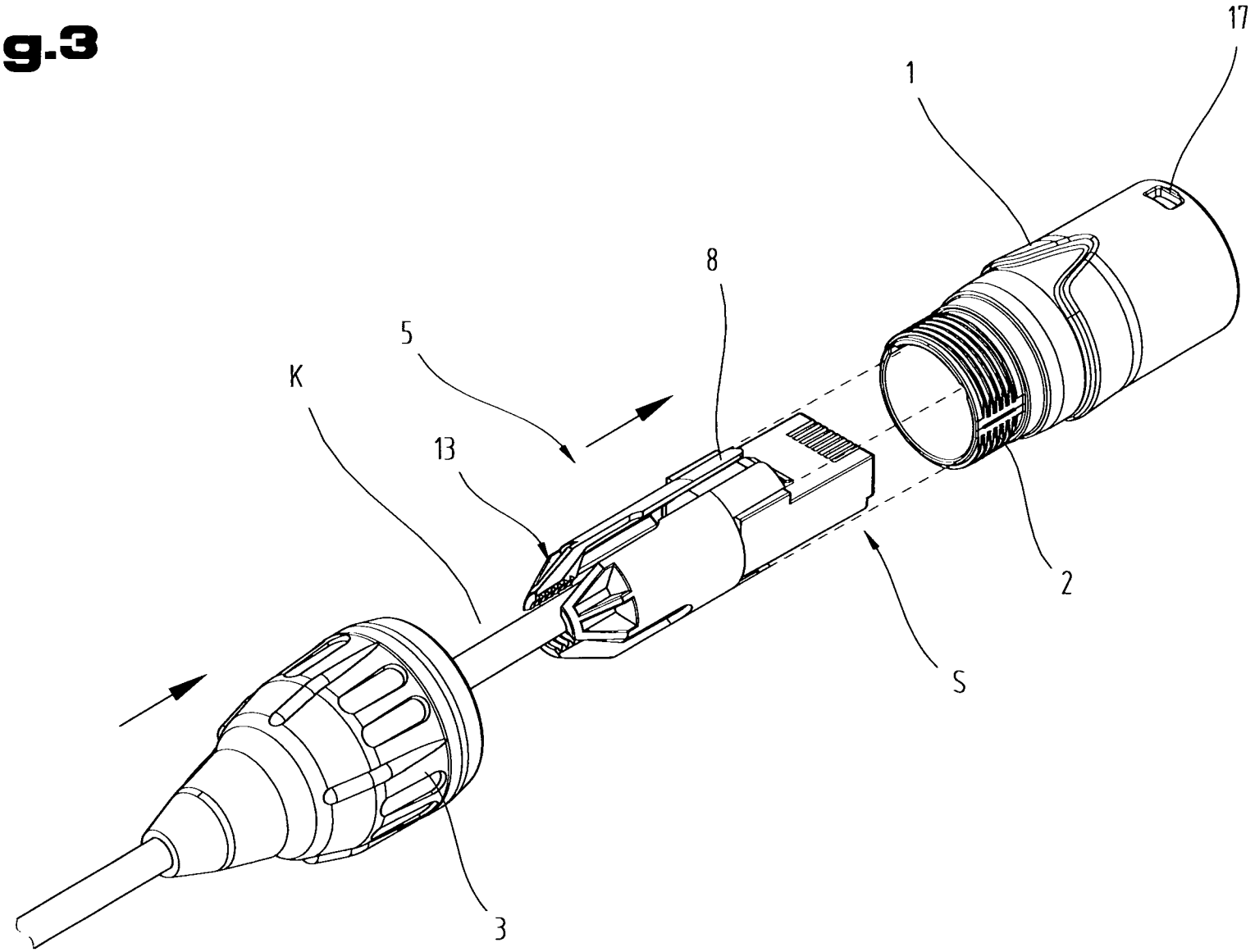
FIG. 3 the plug arrangement of FIG. 2 from a different direction and with the cable plug abutting on the clamping element in the installation position as well as with the cable.
Figure 4:
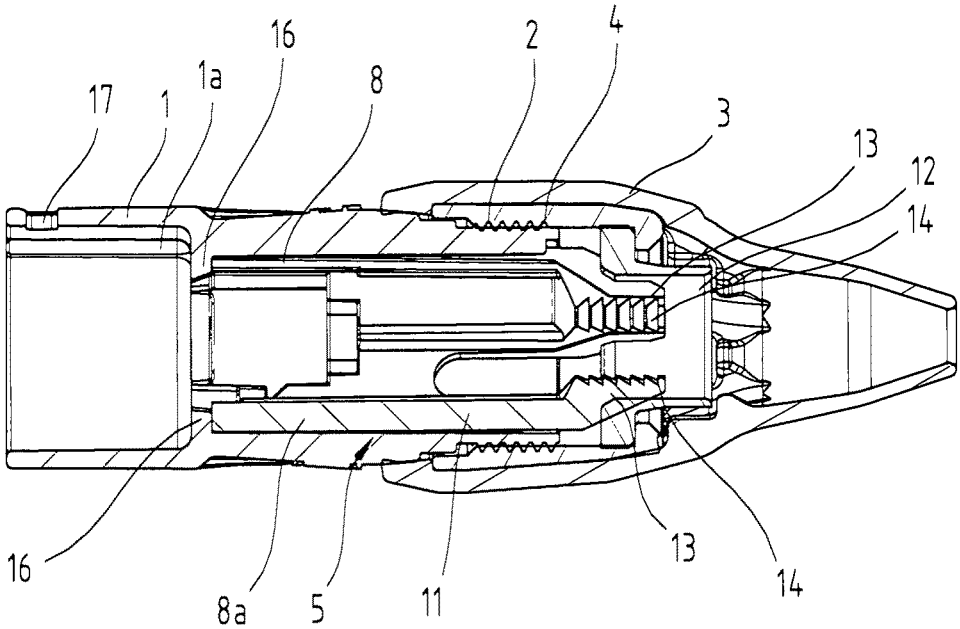
FIG. 4 a longitudinal section along the cable axis through an assembled plug arrangement, without cable and cable plug.
Figure 5:
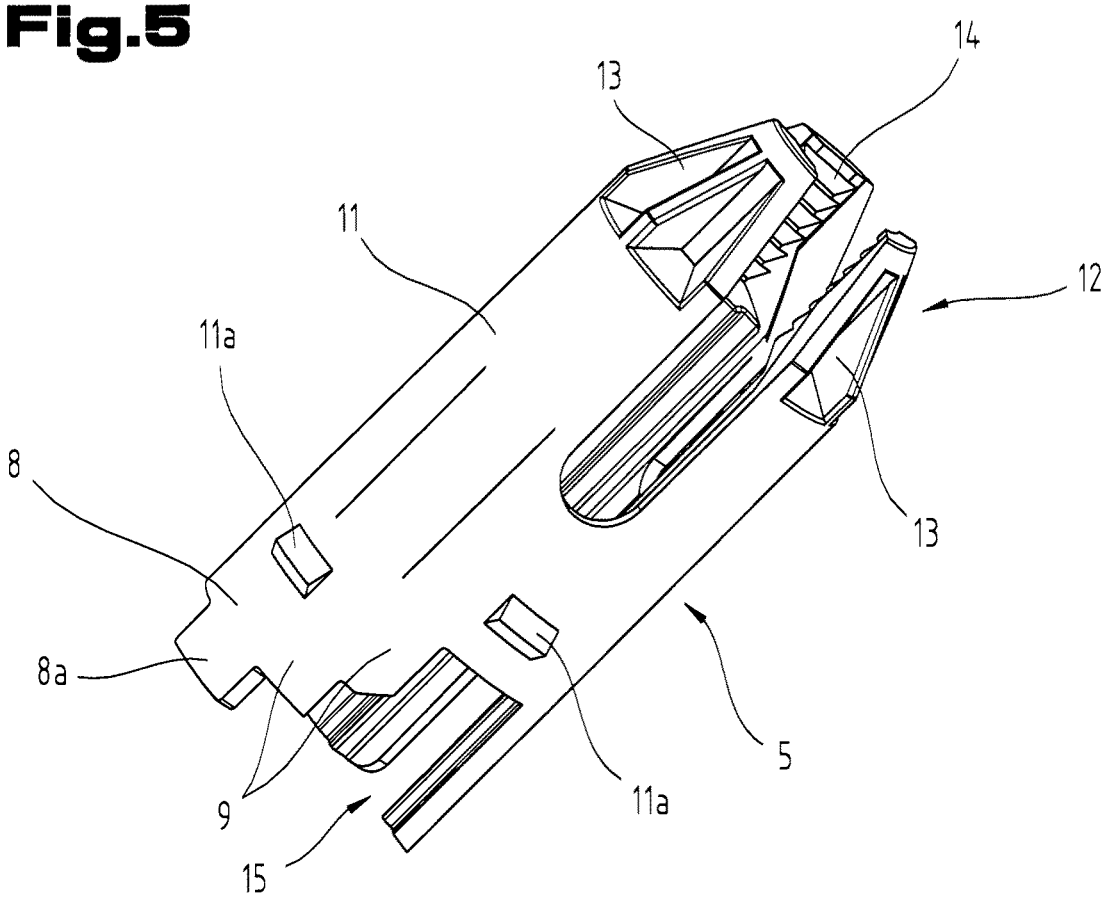
FIG. 5 a clamping element in its embodiment in a slightly perspective side view.
Figure 6:
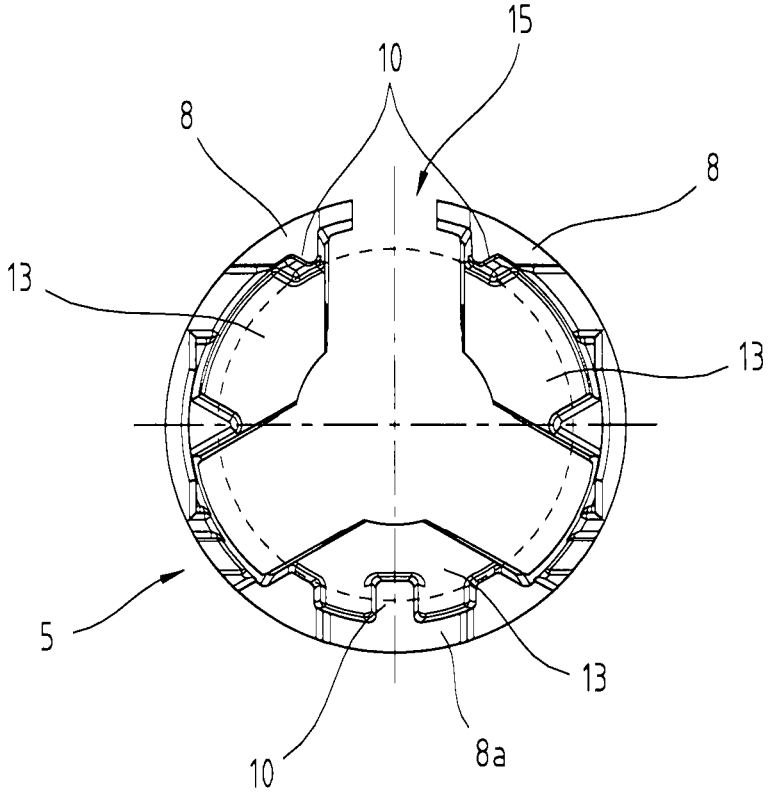
FIG. 6 the clamping element of FIG. 5 in a front view, seen from the direction of the cable plug.

At the front end of the clamping element 5, which is shown in different views and sections in FIGS. 5 to 13, multiple fingers 8 and 8*a* distributed circumferentially about the central longitudinal axis and oriented in parallel thereto are formed, which fingers 8 and 8*a* extend from the middle part 11 of the clamping element 5 to the plug-in end of the housing 1. Preferably, three fingers 8, 8*a* are formed and extend over up to about one third of the total length of the clamping element 5. The cable plug s is inserted—as it is shown in FIG. 3—between the fingers 8, 8*a* and is then accommodated between the fingers 8, 8*a* at the latest when the threaded connection of the housing 1 and the clamping sleeve 3 is tightened, and is then safely positioned in a very precisely defined position due to the guidance of the clamping element 5 in the housing 1 and the clamping between the clamping element 5 and inside the housing 1, and is also safely fixed in the plug arrangement by means of the clamping between the housing 1 and the clamping element 5, both with respect to the direction of rotation about the direction of the longitudinal axis and in the longitudinal direction of the plug arrangement.

An embodiment, in which a clamping element 5 is configured for the use with cable plugs S of different outer dimensions, is particularly preferred. This can be achieved, for example, by at least one shoulder 9 and/or offset being formed, in a staggered manner, on at least one of the fingers 8, 8*a* in the circumferential direction and in the longitudinal direction of the clamping element 5, as a front-side stop surface for the cable plug S of differently dimensioned cable plug S. This can be seen clearly in FIG. 5. In this regard, the cable plug S does not immediately abut on the middle part 11 of the clamping element 5 anymore, but only on the offsets 9 of the fingers 8, 8*a*.

Preferably, two or also multiple shoulders 9 are provided. The rear side of a cable plug S inserted between the fingers 8, 8*a* then comes to abut on one of the shoulders 9 depending on the dimensions of the cable plug. This is depicted for two different cable plugs s in the FIGS. 16 and 17 in a front view. Then, as soon as the clamping sleeve 3 is screwed onto the housing 1 and the threaded connection is tightened, the rear end of the cable plug S is accommodated between the fingers 8, 8*a*, abuts on at least one front face of one of the shoulders 9 and is thus safely positioned and fixed within the housing 1. For the safe and precisely defined positioning of as well as for guiding the cable plug S during the insertion into the clamping element 5, guide ridges 8*b* having a tooth-shaped cross-section are advantageously formed on the fingers 8, 8*a*, which guide ridges 8*b* come into contact with the outside of the cable plug S to guide and hold it.

Furthermore—as it is clearly depicted in FIGS. 2, 6, 10, 13, 16 and 17—a radially inwardly protruding web 10 can be formed on at least one of the fingers 8*a*, in order to thus significantly increase the stability of said finger 8*a* and consequently of the entire clamping element 5. This is advantageous particularly when this holding arm 8*a* is meant and formed for holding a spring tongue F of the cable plug S in the position deformed in the direction of the cable plug housing, so that the spring tongue F neither obstructs the assembly of the plug arrangement nor the establishment and release of the plug connection with the counterpart of the plug arrangement. The locking and unlocking of the plug connection is accomplished by other mechanisms on or in the plug arrangement and not by means of the spring tongue F of the cable plug S.

The holding arm 8*a* for the spring tongue F can be configured in one piece, however, it could be configured to be divided in the direction of the longitudinal axis of the clamping element 5, wherein the division region only extends across the length of the receiving region of a cable plug S. The or any web 10 can also be used for guiding the cable plug S in the direction of the longitudinal axis upon insertion of the same into the clamping element 5, as well as contribute to the safe positioning of the cable plug S in the circumferential direction of the plug arrangement by forming a stop for one of the longitudinal edges of the cable plug S, which plug prevents a—further—rotation of said cable plug S within and relative to the clamping element 5.

Similar to the known embodiment of the clamping element 5, this one has a cylindrical middle part 11 adjoining the fingers 8, 8*a* of the front end and a preferably conically tapering rear end 12 opposing the fingers 8, 8*a*.

Said rear end 12, in turn, has at least two radially compressible fingers 13, whose surfaces facing the cable K are configured for an increased positive or frictional connection with the cable K. These surfaces can, for example, have a sawtooth-like profile, so that the tips of the saw teeth push into the plastic encasement of the cable upon compression of the fingers 13 in the course of the tightening of the threaded connection between housing 1 and clamping sleeve 3, and thus effect the clamping between cable K and clamping element 5. This way, tensile stresses of the cable K are separated from the cable plug S and instead are transferred via the clamping element 5 on to the housing 1, and absorbed by the latter and/or by the plug connection between housing 1 and the corresponding plug socket.

The clamping element 5 is preferably designed in one piece and has, for an easy and quick mounting onto the cable, a continuous longitudinal slit 15 along the length of the clamping element 5. This offers the possibility to pull apart the clamping element 5 in the circumferential direction, after which it can then be easily pushed onto the cable K. A longitudinal web protruding from the internal wall of the plug housing 1, extending in parallel to the longitudinal axis of the same engages with the slot formed between the two longitudinal sides of the slit 15 of the clamping element 5. The longitudinal slot of the clamping sleeve and the longitudinal web cooperate and form a guide and/or a rotation prevention and effect the exact alignment of the clamping sleeve in the circumferential direction of the plug housing.

However, the clamping element 5 can also be designed to be completely closed in the circumferential direction and is then pushed onto the cable K in its longitudinal direction before mounting the cable plug S. In this case, appropriate structures are to be formed on the clamping element 5 and in the housing 1 for the rotation preventing guide, for example, a longitudinal slot that does not penetrate the entire material thickness of the clamping element 5 or protrusions in and/or on the clamping element 5 arranged to be aligning in the direction of the longitudinal axis for receiving a longitudinal rib in the housing 1 or for engaging with a longitudinal slot in the housing 1, so that a rotation prevention of the clamping element 5 in the housing 1 is ensured.

When assembling the plug arrangement, first, the clamping sleeve 3 is pushed over the end of the cable with the cable plug. Subsequently, the clamping element 5 can be applied to the cable, wherein the cable is guided through the longitudinal slit 15 toward the longitudinal central axis of the clamping element 5. Then, the clamping element 5 is pushed forward toward the cable plug, which consequently arrives at a lying position between the fingers 8 and is supported by their shoulders 9. The entire arrangement of cable, cable plug and clamping element 5 is then inserted into the housing 1.

Figure 14:
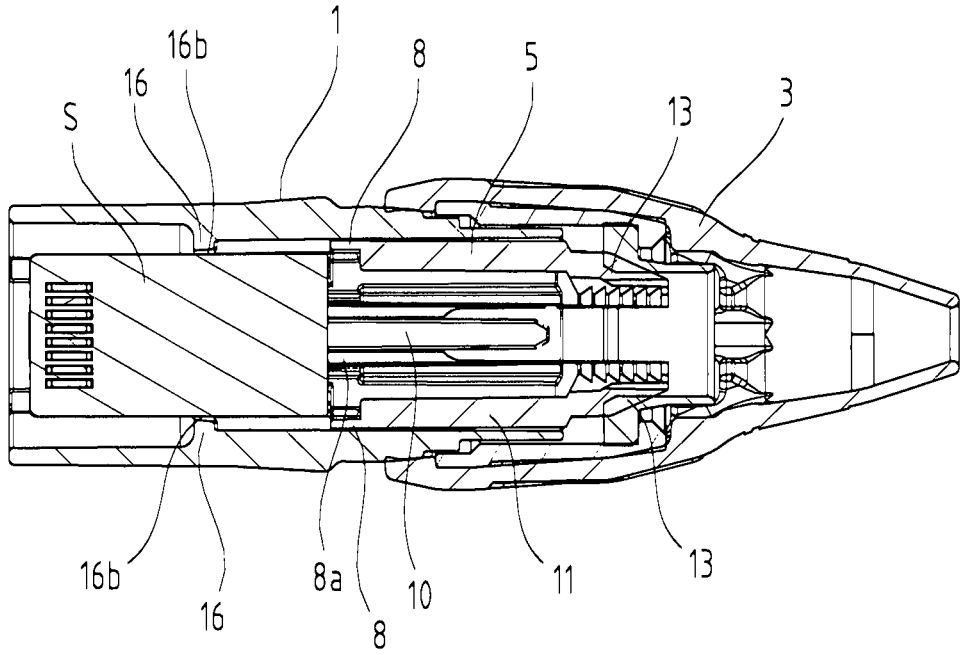
FIG. 14 a longitudinal section, rotated by 90 degrees, through a plug arrangement as shown in FIG. 4, however, with the cable plug inserted.
Figure 15:
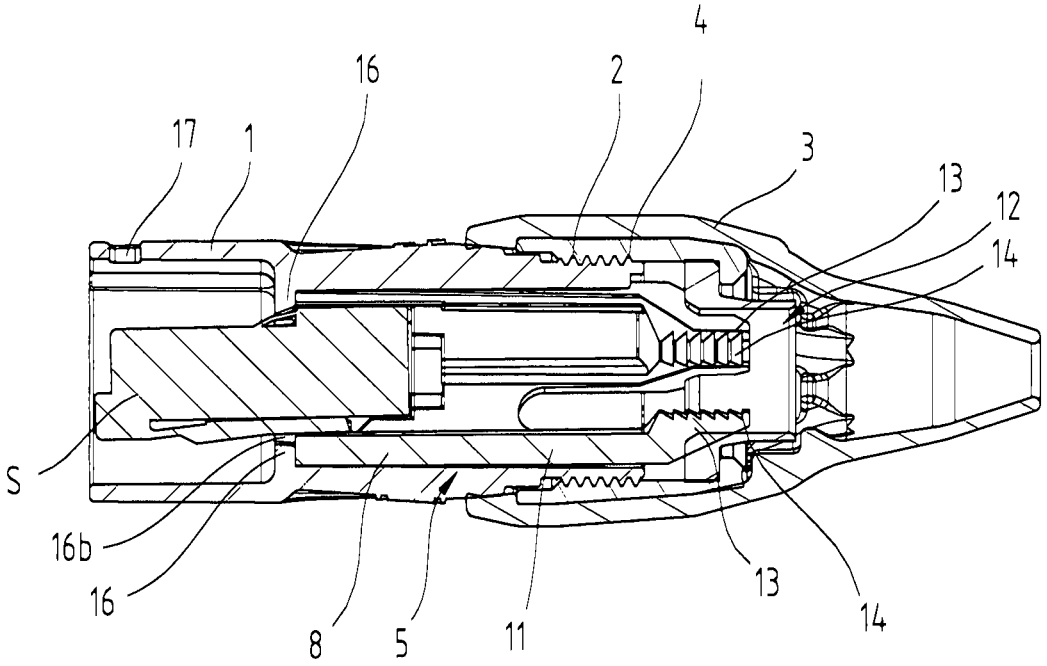
FIG. 15 a longitudinal section along the cable axis according to FIG. 4, now with the cable plug and inserted, however, without the cable.
Figure 16:
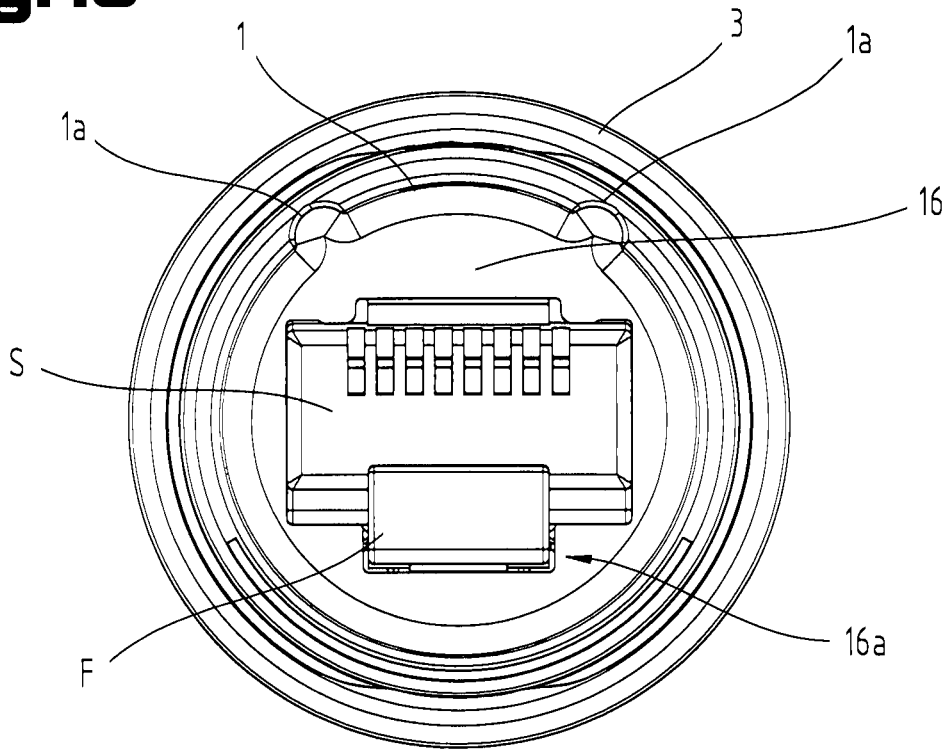
FIG. 16 a front view of the plug arrangement of FIG. 14.
Figure 17:
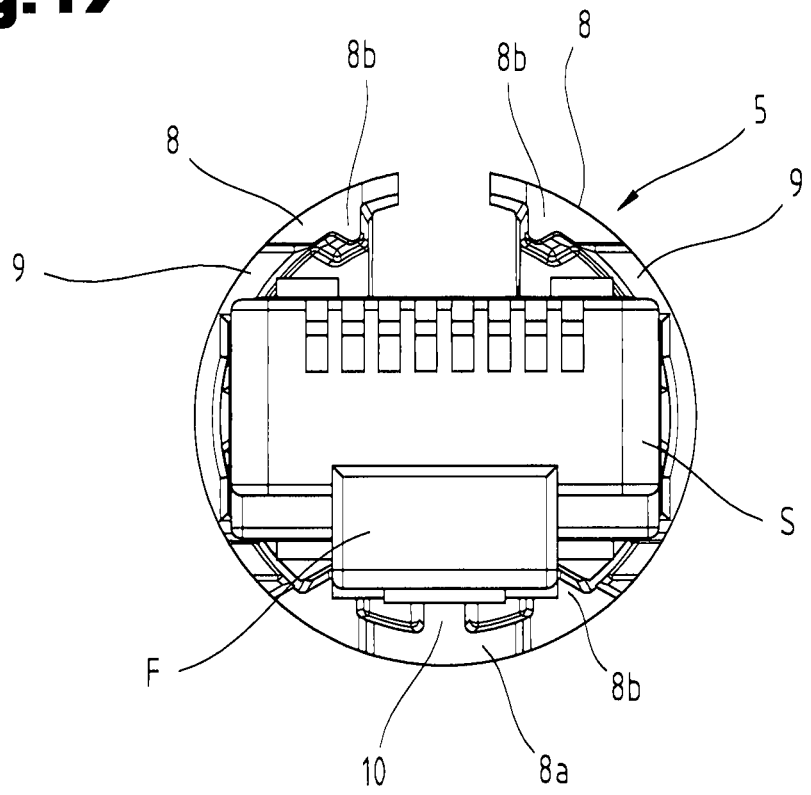
FIG. 17 a front view of the clamping element with the cable plug inserted.
Figure 18:
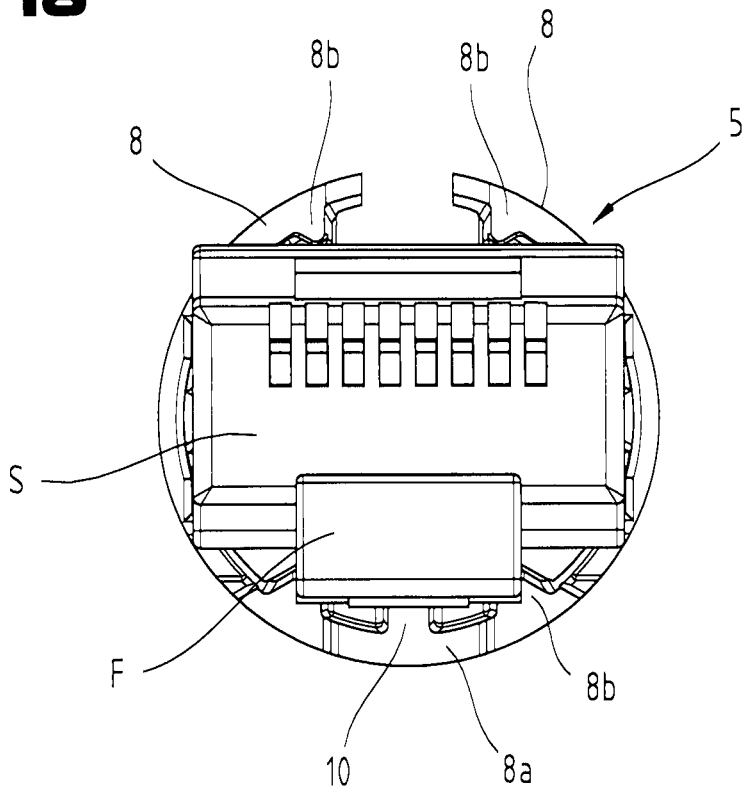
FIG. 18 a front view according to FIG. 17, with cable plugs of different dimensions inserted.
Figure 19:
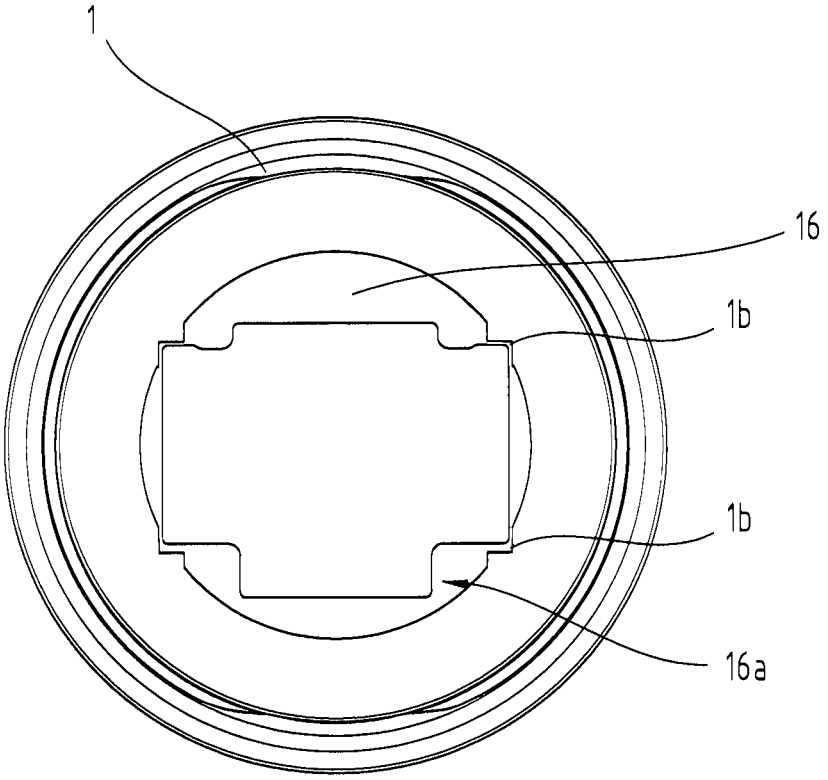
FIG. 19 a view of the housing from the side of the clamping sleeve.

Preferably, a cross-section constriction in the form of a broken-through dividing wall 16 is arranged in the housing 1, which dividing wall 16 forms a stop for the front end of the finger 8. At least the two fingers 8 immediately adjoining the longitudinal edge of the longitudinal slit 15 of the clamping element 5 form, with their front sides, the stops for the longitudinal positioning of the clamping element 5 in the housing 1. The front end of the cable plug S protrudes, as is shown in FIG. 14 in the longitudinal section, through the opening in the dividing wall 16, which front end protrudes forward beyond the front sides of the fingers 8, 8*a* of the clamping element 5. The opening is formed according to the cross-section profile of the cable plug S and, if necessary, provided with a recess for receiving the front region of the spring arm F of the cable plug S. Its rear region is preferably held in a depressed position by the finger 8*a*. The recess in the dividing wall 16 is preferably dimensioned, such that the front end of the finger 8*a* is also accommodated and the dividing wall 16 can grip through to safely hold the spring arm F in a depressed position. In this case, the front side of the first shoulder 9 of the finger 8*a* is intended as the stop on the dividing wall 16. If necessary, the dividing wall 16 could also have a recess extending in the direction of the longitudinal axis for receiving the finger 8*a*.

If necessary, the function of forcing the spring arm F down can also be effected by a correspondingly dimensioned recess in the dividing wall 16. The dividing wall 16 is arranged inside the housing 1 on a longitudinal point, which is selected for obtaining the desired positioning of the cable plug S in the housing 1 and with respect to the plug socket for ensuring an optimal plug connection. For this case, an embodiment of the clamping element 5 is provided, in which no long finger 8*a* protruding beyond the spring arm F is present but all fingers 8 have the substantially same length.

In the housing 1 of the plug arrangement, longitudinal guide slots 1*b* or longitudinal guide bars can also be formed on the side of the dividing wall 16 facing the clamping sleeve 3, which guide slots 1*b* or guide bars extend in an aligning manner to the corner regions of the aperture in the dividing wall 16 and serve for correctly guiding the cable plug S in the circumferential direction upon insertion into the housing 1. Longitudinal slots 1*a* on the side of the dividing wall 16 facing the counterpart of the housing 1 in the plug socket mainly serve for indexation, in order to avoid confusion with different, similarly built plug types. Optionally, they can also serve as guides for the circumferentially correct combining for establishing the plug connection.

For completing the plug arrangement, the clamping sleeve 3 is screwed onto the housing 1, so that the threaded connection between the external thread 2 of the housing 1 and the internal thread 4 of the clamping sleeve 3 is established. On the one hand, the rear fingers 13 of the clamping element 5 are thereby pressed onto the cable K and thus, the clamping element 5 is clamped onto the cable K. Simultaneously, the clamping element 5 in with its fingers 8 and possibly also 8*a* is thereby moved up against the dividing wall 16 and/or clamped between the clamping sleeve 3 and dividing wall 16, so that all components are braced against one another and the cable plug S is positioned and fixed in the housing 1 in a safe and protected manner. In this regard, by clamping the clamping element 5 and receiving the cable plug S in or on its front side, a very exact positioning in the direction of the longitudinal axis as well as in the circumferential direction of the plug arrangement is ensured. On the other hand, the elasticity of the material of the clamping element 5 and a low slackness, meaning a small intermediate space 16*b*, between the internal wall of the recess in the dividing wall 16 and the cable plug S offer the possibility that the cable plug S can be pivoted by a small angle at least in the direction of at least one of the two main axes of the recess in the dividing wall 16. Thus, small tolerances and differences in orientation of the plug arrangement and its counterpart can be compensated, whereby the plugging together of the two complementary assembly groups for establishing the connection between two cable ends and/or one cable end and one appliance is substantially simplified.

Figure 7:
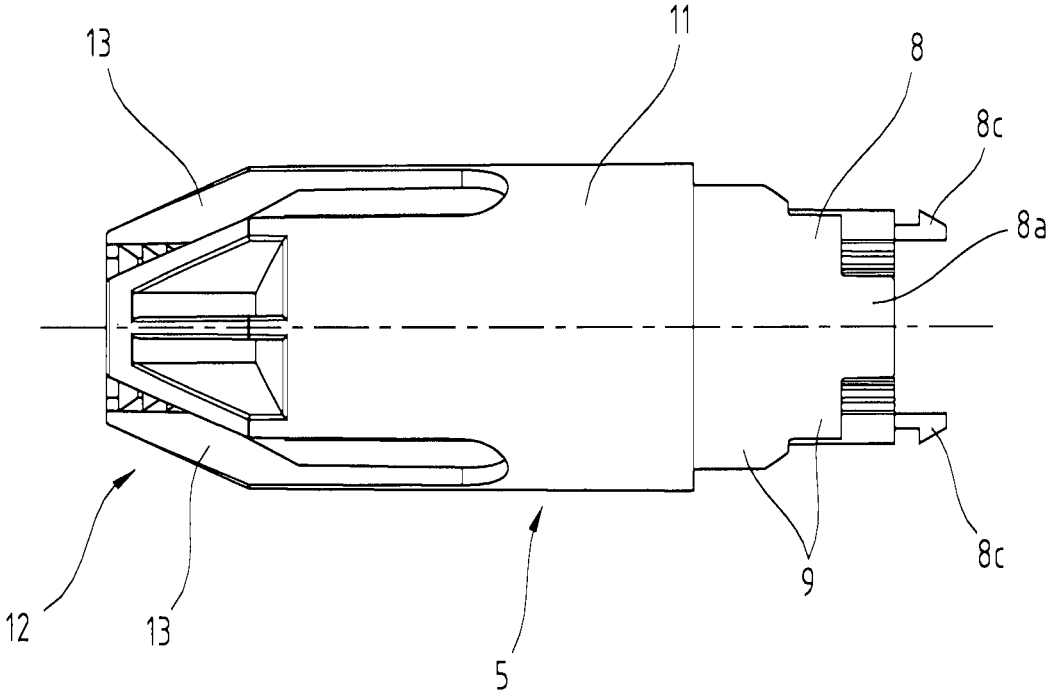
FIG. 7 a side view of the clamping element of FIG. 4.
Figure 8:
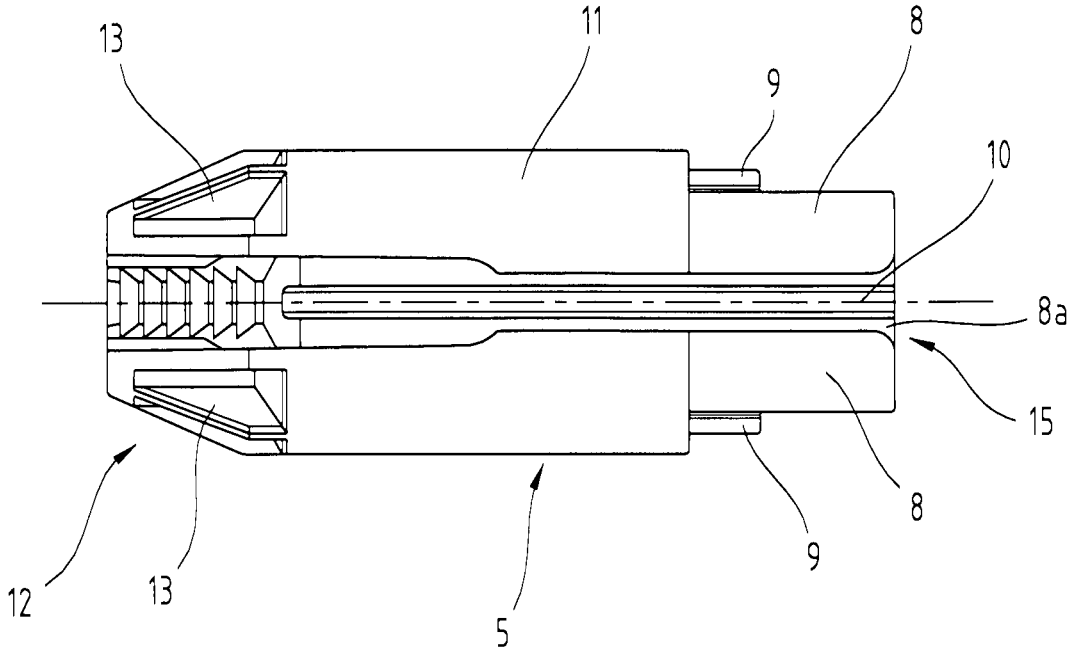
FIG. 8 a side view, rotated by 90 degrees, of the clamping element of FIG. 7.
Figure 9:
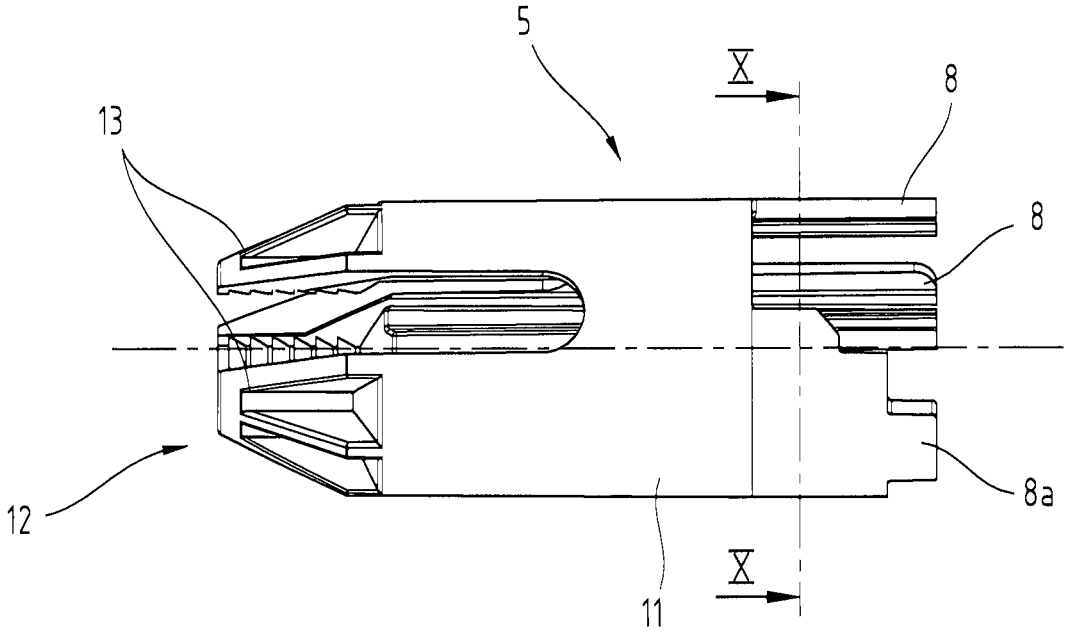
FIG. 9 a side view, rotated by 45 degrees, of the clamping element of FIG. 7.
Figure 10:
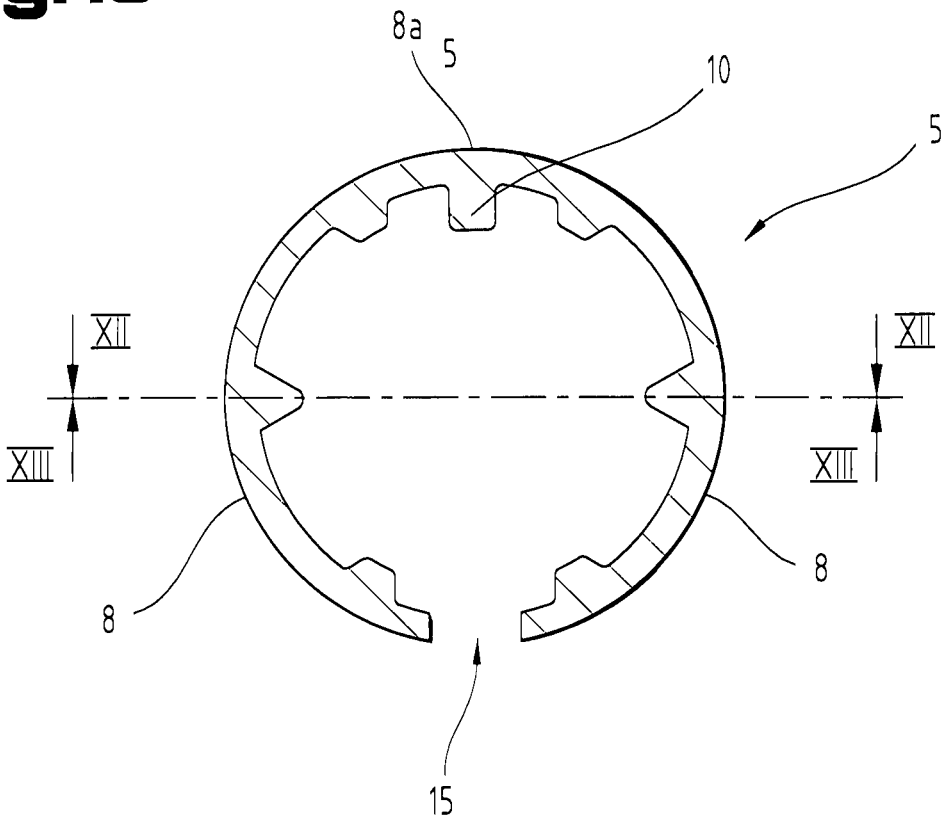
FIG. 10 a section along the line X-X of FIG. 9.
Figure 11:
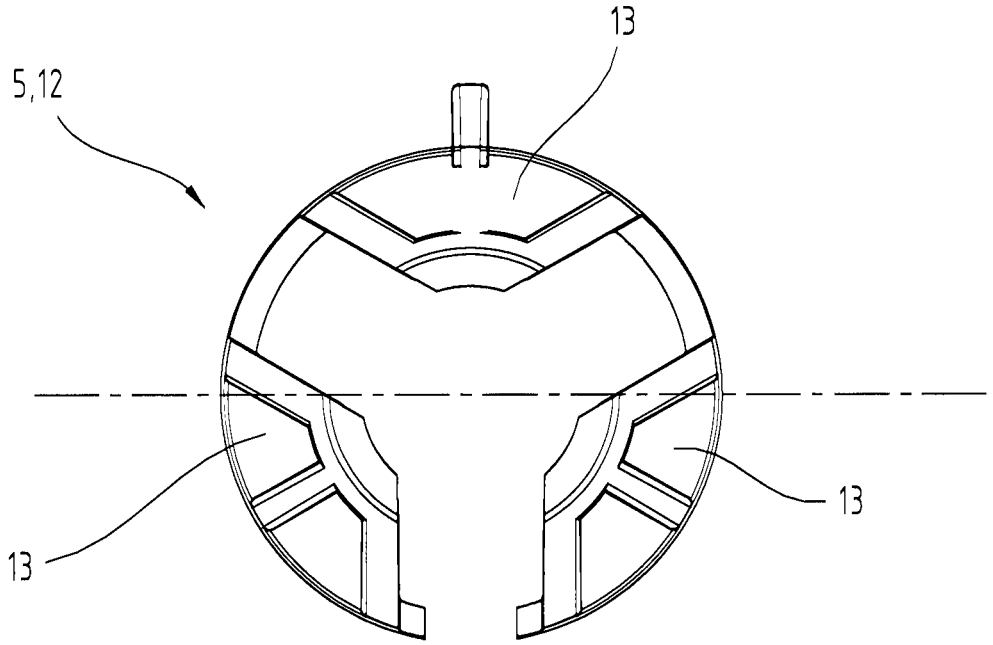
FIG. 11 a view of the clamping element of FIG. 7 onto the rear end.
Figure 12:
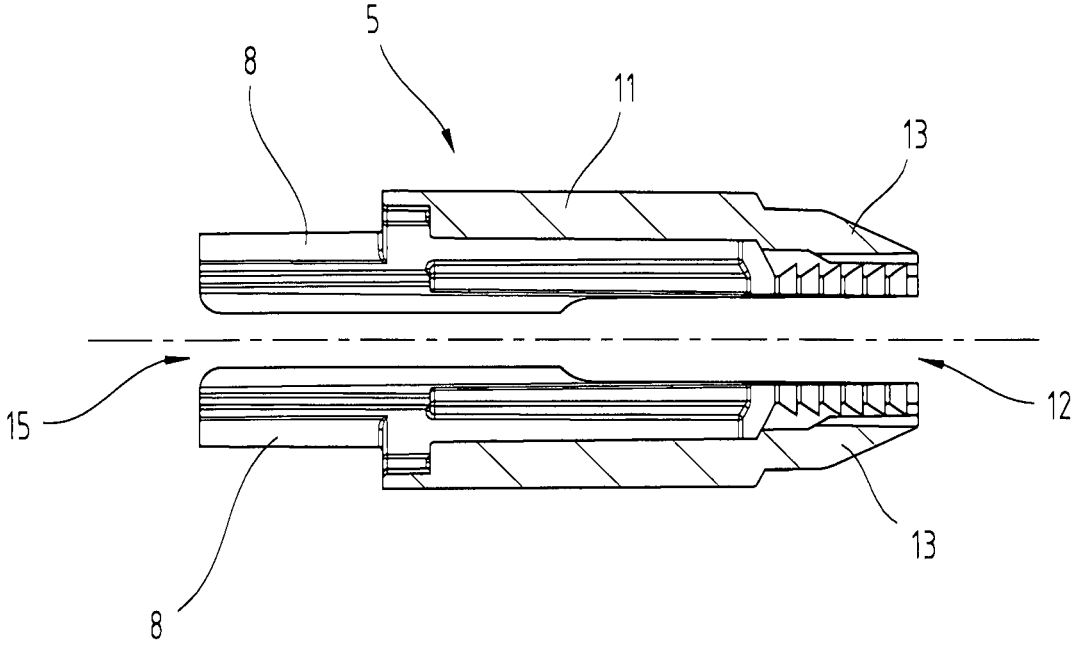
FIG. 12 a longitudinal section through the clamping element of FIG. 7 along the line XII-XII of FIG. 10 in the direction of the small arrows.
Figure 13:
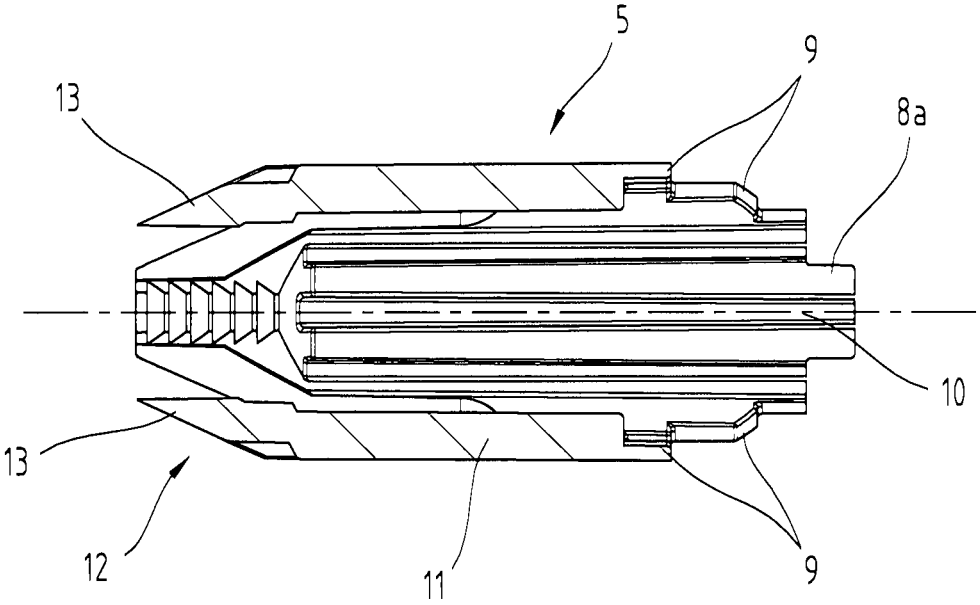
FIG. 13 a longitudinal section through the clamping element of FIG. 7 along the line XII-XII of FIG. 10 opposite to the direction of the small arrows.

On the front sides of the fingers 8, 8*a*, latch projections 8*c*—please refer to FIG. 7 on this—for fixating the clamping element 5 inside the housing 1 can be formed where appropriate, in order to fixate the clamping element 5 in the housing 1 and to protect it against pulling out or sliding out. Latch projections 11*a* which engage with complementary structures in or on the inside of the housing 1 could, if necessary, also be positioned on the circumferential surface of the clamping element 5, in the region of the fingers 8, 8*a* or of the middle part 11, as is shown by way of example in FIG. 5.

Figure 20:
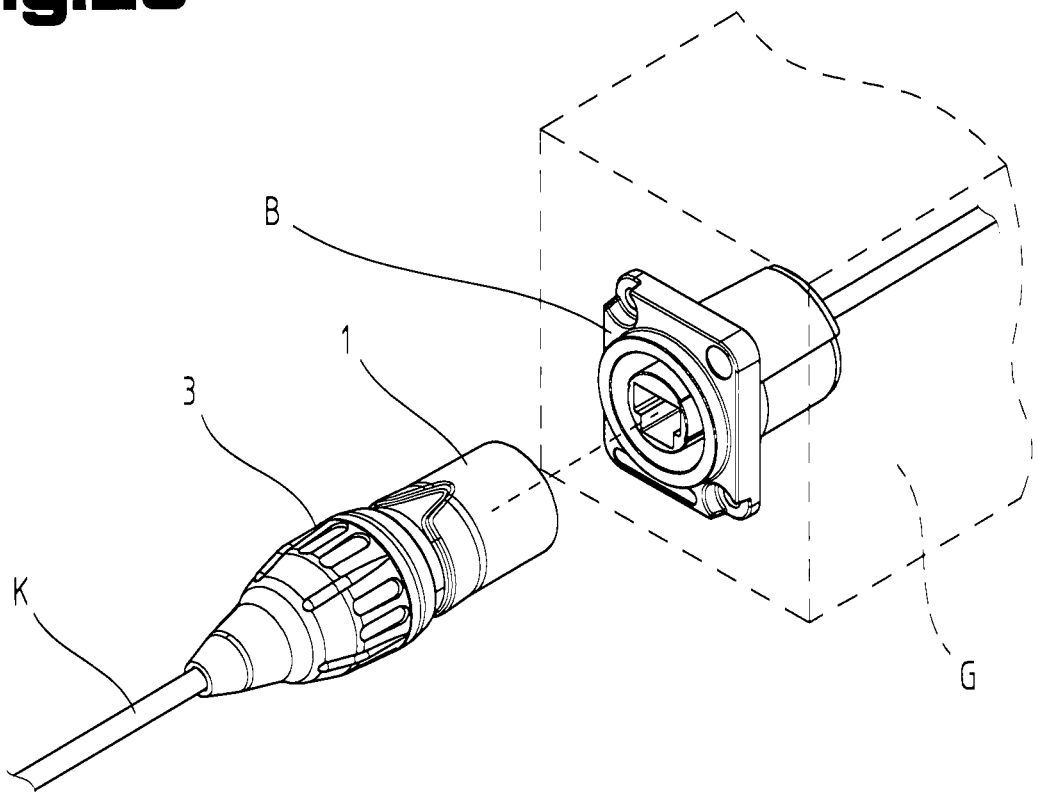
FIG. 20A representation of a complete system including cable, cable plug and complementary plug socket in an appliance.

Using a plug arrangement as it is described above, a particularly robust plug connection can be realized by a plug socket B being provided for the correspondingly receiving the plug arrangement 1, 3, 5. The housing 1 can, if necessary, be provided with a longitudinal slot, and the plug socket B, which is built into an appliance G (please refer to FIG. 20 on this), for example as a built-in plug connector, can be provided with a corresponding counter-longitudinal rib, in order to ensure the orientation of the plug arrangement with respect to the plug socket B upon insertion of the plug arrangement into the plug socket. In order to avoid the inadvertent removal of the cable plug, additionally, a snap latch and/or spring latch can be provided as an optional further feature for the releasable connection of the plug arrangement with the plug socket. This snap latch then preferably meshes with an indentation 17 on the outside of the housing 1.

The exemplary embodiments and the preceding description as well as the enclosed drawings disclose possible embodiment variants, wherein, however, the invention is not limited to the specifically represented embodiment variants. In fact, various combinations of the individual embodiment variants are possible, and due to the teaching of the present invention, and this possibility of variation owing to the teaching provided by the present invention lies within the ability of the person skilled in the art in this technical field.

The invention claimed is:

1. A plug arrangement for use with cables having cable plugs, comprising:

a) a housing for receiving the cable plug, with a thread arranged on a face of the housing;

b) a dividing wall in the housing between an insertion-side region and a cable-side region, wherein the dividing wall has an aperture for passing through the cable plug;

c) a clamping element which is radially compressible and encompasses the cable and is accommodated in the housing, which clamping element, in a compressed state, clamps the cable and whose front end facing the cable plug is formed for accommodating and positioning the cable plug in a predetermined position at the front end of the clamping element or is provided with at least one stop for the cable plug;

d) a clamping sleeve having a thread on a surface of the clamping sleeve for forming a threaded connection with the thread on the housing, wherein, when the threaded connection is tightened, the clamping sleeve, the clamping element, the housing and the cable are braced together;

e) multiple fingers distributed about the central longitudinal axis of the clamping element and oriented in parallel thereto at the front side of the clamping element as a receptacle and/or stop for the cable plug and as a stop for the dividing wall, wherein the fingers abut on said dividing wall at least when the threaded connection is tightened;

f) at least one guide for the clamping element, which guide extends in parallel to the direction of the longitudinal axis, is arranged inside the housing, wherein said guide cooperates with a complementary structure on the clamping element or with the cable plug itself, wherein, when the threaded connection is tightened, the cable plug is positioned and fixed so as not to rotate with respect to the housing and the clamping element.

2. The plug arrangement according to claim 1, wherein the guide for the clamping element and the complementary structure on the clamping element are formed as a web extending in parallel to the direction of the longitudinal axis of the housing and as a slot extending in parallel to the direction of the longitudinal axis of the housing.

3. The plug arrangement according to claim 1, wherein at least one shoulder is formed laterally when seen in the circumferential direction, on at least one of the fingers as a receptacle and/or stop for the cable plug.

4. The plug arrangement according to claim 1, wherein on at least one of the fingers, a web protruding radially inwardly is formed.

5. The plug arrangement according to claim 1, wherein at least one of the fingers is preferably positioned and dimensioned such that a possible spring arm of the cable plug is retained in a position pressed toward the housing of the cable plug by means of said finger.

6. The plug arrangement according to claim 1, wherein the clamping element has a cylindrical middle part adjoining the fingers and a rear end opposing the fingers, wherein the rear end has at least two radially compressible fingers, whose surfaces facing the cable are configured for an increased positive or frictional connection with the cable.

7. The plug arrangement according to claim 1, wherein a recess is provided in the housing for receiving a possible spring arm of the cable plug and/or a finger of the clamping element, wherein when the spring arm is received, the spring arm is retained in the recess in a pressed position.

8. The plug arrangement according to claim 1, wherein the clamping element has a continuous longitudinal slit parallel to the axis along the length of the clamping element, wherein the clamping element can be elastically pulled apart in its circumferential direction and pushed onto the cable.

9. A plug connection using a plug arrangement according to claim 1, wherein, for establishing at least one electric connection, a plug socket is provided to correspondingly receive a plug arrangement according claim 1.

10. The plug connection according to claim 9, wherein the housing and the plug socket are provided with complementary structures for longitudinally guiding the housing in the plug socket, to ensure the orientation of the plug arrangement with respect to the plug socket upon insertion of the plug arrangement into the socket, wherein the housing is provided with a longitudinal slot and the plug socket is provided with a corresponding counter-longitudinal rib.

11. The plug connection according to claim 9, wherein a snap latch for the releasable connection of the plug arrangement with the plug socket is provided, wherein the snap latch engages with an indentation on the outside of the housing.

12. The plug arrangement according to claim 1, wherein an intermediate space is formed between the inner wall of the aperture in the dividing wall and the cable plug.

13. A plug arrangement for use with cables having cable plugs, comprising:

a) a housing for accommodating a cable plug;

b) a dividing wall in the housing between an insertion-side region and a cable-side region, wherein the dividing wall has an aperture for passing through the cable plug;

c) a radially compressible clamping element encompassing a cable and accommodated in the housing, which clamping element, in the compressed state, clamps the cable, and whose front end facing the cable plug is formed for accommodating and positioning the cable plug in a predetermined position at the front end of the clamping part or is provided with at least one stop for the cable plug;

d) a clamping sleeve;

e) a connection arrangement between housing and clamping sleeve;

f) multiple fingers at the front side of the clamping element as a receptacle or stop for the cable plug and as a stop for the dividing wall, wherein, when the connection arrangement is tightened, the cable plug is positioned and fixed so as not to rotate with respect to the housing and the clamping element; and g) a guide arrangement between the housing and clamping element.

14. The plug arrangement according to claim 13, wherein, inside the housing, at least one guide for the clamping part extending in parallel to the direction of the longitudinal axis is arranged, wherein said guide cooperates with a complementary structure on the clamping element or with the cable plug itself.

15. The plug arrangement according to claim 14, wherein the guide for the clamping element and the complementary structure on the clamping element are configured as a web extending in parallel to the direction of the longitudinal axis of the housing and as a slot extending in parallel to the direction of the longitudinal axis of the housing.

16. The plug arrangement according to claim 13, wherein on at least one of the fingers, at least one shoulder is formed laterally when seen in the circumferential direction.

17. The plug arrangement according to claim 16, wherein on at least one of the fingers, a web protruding radially inwardly is formed.

18. The plug arrangement according to claim 13, wherein at least one of the fingers is positioned and dimensioned such that a possible spring arm of the cable plug is held in a position pressed toward the housing of the cable plug by said finger.

19. The plug arrangement according to claim 13, wherein the clamping element has a cylindrical middle part and a rear end opposing the fingers, wherein the rear end of the clamping element has at least two radially compressible fingers.

20. The plug arrangement according to claim 13, wherein an intermediate space is formed between the inner wall of the aperture in the dividing wall and the cable plug.

21. The plug arrangement according to claim 13, wherein a recess is provided in the housing for accommodating a possible spring arm of the cable plug and/or a finger of the clamping element, wherein when the spring arm is accommodated, the spring arm is held in a pressed position in the recess.

22. The plug arrangement according to claim 13, wherein the clamping element has a continuous longitudinal slit parallel to the axis along the length of the clamping element, and the clamping element can be elastically pulled apart in its circumferential direction and pushed onto the cable.

* * * * *